United States Patent [19]

McClaflin et al.

[11] 3,981,808

[45] Sept. 21, 1976

[54] SOLUBLE OIL CONCENTRATE

[75] Inventors: Gifford G. McClaflin; Albert M. Durr, Jr., both of Ponca City, Okla.

[73] Assignee: Continental Oil Company, Ponca City, Okla.

[22] Filed: Oct. 15, 1975

[21] Appl. No.: 622,598

[52] U.S. Cl. ..... 252/33.3; 72/42; 252/49.5

[51] Int. Cl.[2] ..... C10M 1/40; C10M 3/34; C10M 5/22; B21B 45/02

[58] Field of Search ..... 252/33.3, 49.5; 72/42

[56] References Cited

UNITED STATES PATENTS

| | | | |
|---|---|---|---|
| 3,071,544 | 1/1963 | Rue | 252/33.3 |
| 3,201,349 | 8/1965 | Quanstrom | 252/33.3 |
| 3,897,349 | 7/1975 | Marin et al. | 252/33.3 |
| 3,933,661 | 1/1976 | Abrams et al. | 252/49.5 |

*Primary Examiner*—Delbert E. Gantz
*Assistant Examiner*—I. Vaughn
*Attorney, Agent, or Firm*—Richard W. Collins

[57] ABSTRACT

A soluble oil concentrate for forming stable emulsions of a minor part of concentrate and a major part of water. The concentrate comprises a combination of paraffinic and naphthenic base oils with an emulsifier package including a mahogany sulfonate, alkali metal hydroxide, alkylol amine, alkylene glycol, and carboxylic acids including fatty, rosin, and naphthenic acids.

4 Claims, No Drawings

SOLUBLE OIL CONCENTRATE

BACKGROUND OF THE INVENTION

1. Field of the Invention

This invention relates to soluble oil concentrates for forming stable emulsions with water, and more particularly to soluble oil concentrates which are capable of forming stable emulsions of a minor part of concentrate and a major part of water, such as are used in roof support jacks in mines. Because of the use to which these emulsions are subjected, which in many cases involves standing static for thirty days or more in a mine roof support jack, the emulsions must have extremely good stability. Emulsions formulated according to this invention also have utility as cutting oils for machining operations.

2. Description of the Prior Art

There are numerous references in the literature describing soluble oil formulations for forming stable emulsions with water, U.S. Pat. Nos. 2,307,744; 2,470,913; 2,670,310; 2,695,272; 2,846,393; and 2,913,410 are representative of references describing emulsifiable oil compositions of the type to which this invention is directed. The compositions described in these prior art patents generally include mineral oil and an emulsifier package comprising an emulsifier, a coupling agent, and various additives. The composition described in U.S. Pat. No. 2,846,393 includes an emulsifier, mineral oil, alkali metal hydroxide, hexylene glycol, alkali metal resinate, and a sulfurized addend. This composition is stated to be compatible with both hard and soft waters and includes sodium mahogany sulfonate as the preferred emulsifier. The composition is primarily designed as a cutting oil, and the sulfurized addend is apparently included in order to provide proper lubrication for this purpose. While these prior art compositions have been quite satisfactory in many instances, there has nevertheless been a continuing need for an oil soluble concentrate capable of forming a stable emulsion, particularly for use in roof support jacks. Such a composition is provided by this invention.

SUMMARY OF THE INVENTION

According to the present invention, an emulsifier system capable of emulsifying a paraffinic base oil is combined with an emulsifier system capable of emulsifying a naphthenic base oil, and the combined emulsifier systems when added to an appropriate blend of paraffinic and naphthenic base oils provide an improved soluble oil concentrate capable of forming a stable emulsion with hard or soft water. Further, the soluble oil concentrates of this invention do not form a thick surface skin when exposed to the atmosphere over a period of time.

The soluble oil concentrates of this invention comprise a blend of paraffinic base oil and naphthenic base oil with an emulsifier system. The emulsifier system when used with a paraffinic base oil alone was found slightly lacking in emulsion stability whereas the emulsifier system when used with naphthenic base oil alone allowed the oil concentrate to form a surface skin when exposed to the atmosphere and was prone to solidify at reduced temperature. It was found that by combining the emulsifier system with an appropriate mixture of paraffinic and naphthenic base oils that the desirable features of stability and absence of skin formation were obtained.

The combined emulsifier system comprises an emulsifying agent such as sodium mahogany sulfonate combined with fatty acid, rosin acid, naphthenic acid, alkali metal hydroxide, alkylol amine, and alkylene glycol.

It is an object of the invention to provide a soluble oil concentrate capable of forming a stable emulsion with hard or soft water.

It is a further object to provide such a concentrate which does not form a heavy surface skin upon exposure to the atmosphere.

It is a further object to provide such a concentrate which does not coagulate upon exposure to the normal lower storage temperatures.

DESCRIPTION OF THE PREFERRED EMBODIMENTS

Compositions of the type described herein are generally referred to as soluble oils, although these compositions ordinarily form an emulsion when mixed with water. In order to distinguish between the soluble oil concentrate and the emulsion which is produced when the concentrate is mixed with sufficient quantities of water, the term "soluble oil concentrate" will be used to describe the oil plus emulsifier, and the emulsion which is formed when the soluble oil concentrate is mixed with water will be referred to as a "soluble oil emulsion." The emulsion which is formed when the soluble oil concentrate is mixed with water is of the oil-in-water type wherein the aqueous phase constitutes the continuous phase and the mineral oil constituent is the dispersed phase.

Compositions of the present invention are primarily designed for use in hydraulic jacks such as those used to support mine roofs. These jacks are normally left in place for long periods of time, and it is important that the soluble oil emulsions used as hydraulic fluid in such jacks be extremely stable. Conventional hydraulic fluids are not acceptable for this use as they present a fire hazard and a disposal problem, whereas the compositions of this invention are mostly water. It is also important that the soluble oil concentrate be capable of forming a stable emulsion with water available at the point of use, and in many cases this means that the concentrate must be capable of forming a stable emulsion with hard water. The soluble oil concentrates of this invention contain both paraffinic and naphthenic base oils. It is preferred that about one and a half to two parts of paraffinic base oil be used for each part of naphthenic base oil. The concentrate comprises about 65 to 85 percent by weight of the combined base oils, with the balance being an emulsifier system as defined in more detail below.

The emulsifying agent in accordance with the invention may be broadly described as an organic sulfonate, and a particularly desirable sulfonate that may be employed is the sulfonate derived from treatment and purification of petroleum oil with sulfuric acid. The conventional method of recovering sulfonates as byproducts during the refining of petroleum distillates is to dilute the sludge with a hydrocarbon oil. The mahogany acids remain in the resulting oil layer and are separated from the sludge layer which contain the green acids. The oil layer can be washed with aqueous alcoholic solutions which remove the mahogany acids, or it can be treated with alkali and the sulfonic acids recovered with alcohol as mahogany salts. The sludge may be boiled with water and the dilute acid recovered. The supernatant layer may then be neutralized and the residual oil extracted with naphtha or other suitable solvent. The sulfonates thus formed are commonly referred to as mahogany sulfonates, and various salts of such sulfonates such as the alkali metal, alkaline earth, and heavy metal salts thereof may be utilized in accordance with the present invention.

Preferred mahogany sulfonates are the sodium mahogany sulfonates available from Witco under the tradename of PETRONATE. The PETRONATES comprise slightly more than 50 percent sodium mahogany sulfonate in a mineral oil.

The mineral oil diluent improves the handling characteristics of the sulfonate and preferably is the same blend of naphthenic and paraffinic base oils used for the base oil portion of the concentrate.

The concentrates of this invention include a combination of conventionally refined paraffinic and naphthenic base oils, as previously mentioned. Such oils preferably have a viscosity of from 50 to 500 SSU at 100°F, and more preferably at about 100 SSU at 100°F.

Carboxylic acids that may be employed are the fatty, rosin, and naphthenic acids. Suitable fatty acids are the higher fatty acids, both saturated and unsaturated, and particularly those that may be produced or obtained from vegetable and animal glycerides. They may be used as individual fatty acids or as complex mixtures thereof as derived by the saponification of the oils and fats. A preferred fatty acid is tall oil fatty acid. Rosin acids that may be employed are the wood, gum, and tall oil rosin acids produced from pines. A preferred rosin acid is that derived from crude tall oil. A preferred tall oil product is a distillation product which is a mixture of fatty and rosin acids with a rosin acids content of from 18 to 36 percent by weight. The most preferred tall oil distillation product contains about 29 percent by weight rosin acids. Naphthenic acids that may be employed are derived from petroleum and are mixtures of organic acids containing a substituted naphthenic ring structure for which they are named. A preferred naphthenic acid is a refined grade having a high acid number. An example of a suitable naphthenic acid is the one designated E available from Chevron Chemical Company.

The alkylol amines that may be employed include mono-, di-, and tri-alkylol amines derived from ammonolysis of ethylene oxide and/or propylene oxide. The preferred alkylol amine in accordance with the invention is triethanol amine.

The alkylene glycol suitable for use in accordance with the invention may be a 1,2-glycol derived from hydrolysis of an alkylene oxide such as ethylene, propylene, or butylene oxide, a 2,4-glycol such as hexylene (2-methyl-2,4-pentane diol) made by the reduction of acetylacetone, or a diol such as 1,4-butane diol made by reduction of maleic anhydride and its esters. The preferred alkylene glycol in accordance with the invention is hexylene glycol.

The concentrates of this invention may be considered as comprising a blend of paraffinic base oil and naphthenic base oil with a first emulsifier system optimized for use with paraffinic base oil and a second emulsifier system optimized for use with naphthenic base oil. When used separately, the first emulsifier system used with paraffinic base oil was found slightly lacking in emulsion stability, whereas the second emulsifier system used with naphthenic base oil allowed the concentrate to form a skin when exposed to the atmosphere and was prone to solidify at reduced temperature. The combination of the first and second emulsifier systems in conjunction with an appropriate mixture of paraffinic and naphthenic base oils was found to avoid all of these disadvantages.

EXAMPLE 1

To illustrate the necessity for the combined emulsifier package in order to obtain a satisfactory soluble oil concentrate for the purpose of this invention, the following emulsifier packages were prepared.

| Emulsifier Package No. 1 | Wt. % |
|---|---|
| Witco Petronate CR | 50.64 |
| Arizona Chem. Co. Acintol D29LR (Tall Oil Fatty/Rosin Acid) | 25.32 |
| Enjay Naphthenic Acid 1R | 7.59 |
| Aqueous KOH (45%) | 7.59 |
| Triethanol Amine | 8.86 |
| | 100.00 |

| Emulsifier Package No. 2 | Wt. % |
|---|---|
| Witco Petronate CR | 45.61 |
| Arizona Chem. Co. Acintol D29LR (Tall Oil Fatty/Rosin Acid) | 30.41 |
| Aqueous KOH (45%) | 13.45 |
| Hexylene Glycol | 10.53 |
| | 100.00 |

A first concentrate (Sample No. 1) was prepared by mixing 20 parts of Emulsifier Package No. 1 with 80 parts of a paraffinic base oil having a viscosity of 170 SSU at 100°F. A second soluble oil concentrate (Sample No. 2) was prepared by mixing 20 parts of Emulsifier Package No. 2 with eighty parts of a naphthenic base oil having a viscosity of 100 SSU at 100°F. Both of these soluble oil concentrates were poured onto a watch glass and left exposed to the atmosphere for 48 hours. They were then examined for skin formation. The first concentrate (Sample No. 1) showed no surface skin formation. The second concentrate (Sample No. 2) showed a very heavy surface skin.

Soluble oil concentrates in accordance with the invention were then prepared by mixing 14 parts by weight of Emulsifier Package No. 1 and 6 parts of Emulsifier Package No. 2 with 56 parts of the paraffinic base oil and 24 parts of the naphthenic base oil (Sample No. 3), and by mixing 12 parts of Emulsifier Package No. 1 and 8 parts of Emulsifier Package No. 2 with 48 parts of the paraffinic base oil and 32 parts of the naphthenic base oil (Sample No. 4). Sample No. 3 showed only a very thin surface skin at the end of 48 hours exposure to the atmosphere, and Sample No. 4 showed only a medium heavy surface skin after the same exposure. Each of the above concentrates, when stored in a closed container at 38°F for 48 hours, remained as a clear homogeneous liquid.

EXAMPLE 2

Emulsions of each of the above-described samples from Example 1 were then prepared by adding 5 parts of the oil concentrate to 95 parts of water containing 250 ppm hardness as calcium carbonate. Each of the emulsions was stirred for 4 minutes and then divided and transferred into a pair of small neck flasks containing 0.1 ml divisions and ground glass stoppers. The flasks were sealed and one of each pair was stored at ambient temperature and the other at 158°F for 1 week, at which time the emulsions were examined and any separation noted and recorded. The results are shown in the following Table 1.

TABLE 1

| Sample No. | 1 | 2 | 3 | 4 |
|---|---|---|---|---|
| Emulsion Appearance after one week at ambient temp. | | | | |
| Emulsion, ml | 99.75 | 100 | 99.95 | 100 |
| Cream, ml | 0.25 | Trace | 0.05 | Trace |
| Oil Rich, ml | — | — | — | — |
| Oil, ml | — | — | — | — |
| Emulsion Appearance after one week at 158°F. | | | | |
| Emulsion, ml | 99.50 | 100 | 99.95 | 100 |
| Cream, ml | 0.35 | — | 0.05 | Trace |
| Oil Rich, ml | — | — | — | — |
| Oil, ml | 0.15 | — | — | — |

From the foregoing, it can be seen that oil concentrates in accordance with the invention (Sample Nos. 3 and 4) which include a combination of paraffinic base oil and naphthenic base oil provide an excellent combination of emulsion stability with low surface skin formation. On the other hand, Sample No. 1 which contained only a paraffinic base oil did not provide a satisfactorily stable emulsion, and Sample No. 2 which contained only a naphthenic base oil produced a very heavy surface skin.

EXAMPLE 3

To further illustrate a preferred embodiment of an oil soluble concentrate in accordance with the invention, the following composition was prepared:

| Component | Wt. Percent |
|---|---|
| Naphthenic Base Oil | 31.87 |
| Paraffinic Base Oil | 50.52 |
| *Witco Di-Petronate CR | 9.50 |
| Arizona Chemical Co. Acintol FA 1 (Tall Oil Fatty/Rosin Acid) | 0.90 |
| Arizona Chemical Co. Acintol D40LR (Tall Oil Fatty/Rosin Acid) | 3.42 |
| Hexylene Glycol | 0.66 |
| Naphthenic Acid | 0.72 |
| Triethanol Amine | 0.84 |
| Aqueous KOH (45%) | 1.57 |
| | 100.00 |

* Same as Witco Petronate CR except diluted with appropriate base oils for easier handling.

The soluble oil concentrate described above, when emulsified with from 9 to 19 parts by weight of water, has been found to provide a soluble oil emulsion which is suitable for use in mine roof jacks.

It is an essential feature of this invention that the soluble oil concentrate include both naphthenic and paraffinic base oils. Concentrates containing both types of base oil and the emulsifier system as described above are particularly suitable for forming stable emulsions comprising a minor amount of concentrate and a major part of water, which emulsions are particularly useful as hydraulic fluids for mine roof jacks and the like.

Preferred soluble oil concentrates in accordance with the invention comprise the following ingredients in the indicated proportions:

| Component | Percent by Weight |
|---|---|
| Paraffinic base oil | 46–52 |
| Naphthenic base oil | 29–33 |
| Sodium mahogany sulfonate | 8–14 |
| Tall oil fatty/rosin acid | 3–7 |
| Naphthenic acid | 0.5–1 |
| Alkali metal hydroxide (45% aqueous) | 1–2.5 |
| Alkylol amine | 0.5–1.5 |
| Alkylene glycol | 0.5–1 |

It will be apparent to those skilled in the art that minor variations and modifications of the composition described above could be made, such as use of an amount of one or more of the ingredients in an amount slightly outside the above-designated proportions, or substitution of an equivalent ingredient for part or all of one of those above-designated, without departing from the true scope of the invention. It is, however, essential that the concentrate contain a major proportion of both naphthenic and paraffinic base oils along with the indicated components of the emulsifier package in the proportions generally indicated. Broadly stated, the invention can be defined as a soluble oil concentrate comprised of a major amount (above 25 percent by weight) of each of a paraffinic base oil and a naphthenic base oil, a substantial amount (between 3 and 15 percent by weight) of each of a mahogany sulfonate and fatty/rosin acid, and a minor amount (between 0.5 and 3 percent by weight) of each of the remaining components including naphthenic acid, alkylol amine, alkylene glycol, and alkali metal hydroxide or its equivalent. According to a more preferred version of the invention, about one and a half to two pairs of paraffinic oil is used for each part of naphthenic base oil, and the fatty/rosin acids component comprises about 29 percent by weight rosin acids.

We claim:

1. A soluble oil concentrate composition comprising:

a. a major amount of paraffinic base oil;

b. a major amount of naphthenic base oil;

c. an emulsion stabilizing amount of a mahogany sulfonate;

d. an emulsion stabilizing amount of fatty/rosin acid; and e. a minor amount of each of a naphthenic acid, an alkylol amine, an alkylene glycol and an alkali metal hydroxide.

2. The composition of claim 1 wherein said alkylol amine is triethanol amine, said mahogany sulfonate is sodium mahogany sulfonate, said fatty/rosin acid is tall oil distillation product having a rosin acids content of from 18 to 36 percent by weight, and said alkylene glycol is hexylene glycol.

3. The composition of claim 2 wherein the components thereof are present in amounts as follows:

| Component | Percent by Weight |
|---|---|
| Paraffinic base oil | 46–52 |
| Naphthenic base oil | 29–33 |
| Sodium mahogany sulfonate | 8–14 |
| Tall oil fatty/rosin acid | 3–7 |
| Naphthenic acid | 0.5–1 |
| Alkali metal hydroxide (45% aqueous) | 1–2.5 |
| Triethanol amine | 0.5–1.5 |
| Hexylene glycol | 0.5–1 |

4. The composition of claim 3 wherein said tall oil fatty/rosin acid contains 29 percent by weight rosin acids.

* * * * *